United States Patent [19]

Koella, III et al.

[11] Patent Number: 4,543,778

[45] Date of Patent: Oct. 1, 1985

[54] TEXTILE SPINDLE ASSEMBLY AND METHOD

[76] Inventors: Ernest Koella, III, 2023 Wayne Cir., Maryville, Tenn. 37801; Albert D. Harmon, 109 Lakeview Cir., Clemson, S.C. 29631

[21] Appl. No.: 479,171

[22] Filed: Mar. 28, 1983

[51] Int. Cl.[4] ..... D01H 1/38; D01H 9/16

[52] U.S. Cl. ..... 57/303; 57/300; 57/306; 242/18 PW; 242/18 EW

[58] Field of Search ..... 57/300, 303, 306; 242/18 PW, 18 EW

[56] References Cited

U.S. PATENT DOCUMENTS

| | | | |
|---|---|---|---|
| 2,747,359 | 5/1956 | Keefe, Jr. | 57/303 X |
| 3,319,409 | 5/1967 | Bakker | 57/303 X |
| 3,408,011 | 10/1968 | Lenk et al. | 242/18 PW |
| 3,543,499 | 12/1970 | Takizawa et al. | 57/303 |
| 3,575,355 | 4/1971 | Ratti | 242/18 PW |
| 3,669,373 | 6/1972 | Hori et al. | 57/303 X |
| 3,731,479 | 5/1973 | Flowers et al. | 57/303 X |
| 4,013,237 | 3/1977 | Perrino | 242/18 PW |
| 4,050,645 | 9/1977 | Burchette, Jr. et al. | 242/18 PW X |
| 4,208,865 | 6/1980 | Koella, III | 57/303 |
| 4,418,876 | 12/1983 | Sato et al. | 242/18 PW X |

*Primary Examiner*—John Petrakes

*Attorney, Agent, or Firm*—Joseph H. Heard

[57] ABSTRACT

The spindle assembly is of the type having a spool upon which coils of strand material are formed preparatory to doffing of a strand package from the assembly. The coils are formed without overlapping them upon one another, and preferably without permitting their transverse engagement and possible mutual attachment. First and second oppositely directed helical grooves are respectively provided upon upper and lower portions of the spool. The first groove prevents overlapping and transverse attachment of the strand material as the coils are formed. Both grooves position strand material at a location favorable to clearance from the spool.

18 Claims, 4 Drawing Figures

TEXTILE SPINDLE ASSEMBLY AND METHOD

FIELD OF THE INVENTION

This invention relates to spindle assemblies employed in spinning frames and similar machines adapted to form packages of textile strand material. The invention more specifically relates to an improved spindle assembly of the type having a spool-like member about which coils of the strand material are wound preparatory to doffing of a previously formed strand package from the assembly. The invention also relates to the method of forming such coils.

BACKGROUND OF THE INVENTION

In most textile spinning frames and similar machines which repetitively form strand packages upon rotatable spindle assemblies, a limited number of coils of strand material are wound about a spool-like lower portion or member of each spindle assembly before each completed strand package is doffed from the blade-like upper portion or member of the assembly. This is accomplished, in machines having a vertically movable ring rail and a fixed spindle rail, by lowering of the ring rail to a "doff" position below its stroke of normal package-building movement, and simultaneous driving of the spindle assembly through the desired limited number of revolutions. While subsequently ensuing doffing of the completed package separates its strand connection with the coils, the latter maintain connection between the spindle assembly and the strand source pending and during commencement of the formation of a new package. Formation of the new package therefore may be and is commenced automatically when the rail and spindle assemblies are caused to resume their normal operating movements.

After formation of a new package has been commenced, the coils upon the spool of the spindle assembly are no longer necessary or desirable. U.S. Pat. No. 4,208,865, the disclosure of which is incorporated herein by reference, discusses some of the problems presented by such coils and a preferred technique for their elimination. In accordance with such technique or method, the strand connection formed during "start-up" between each set of coils and the "new" strand package is separated after commencement and prior to completion of the formation of such package. This should result in clearance of the coils, relatively promptly and in a substantially intact condition, from the spool of the rotating spindle assembly. A number of effects or influences tend to produce this desired result. Always present ones are the centrifugal and "windage" forces imposed upon the coils by the spindle assembly's rapid rotative movement. The coils may also be periodically subjected to blasts of air from a traveling pneumatic cleaner such as is customarily associated with a textile spinning frame or similar machine. Additionally, some type of mechanical cleaner device may be and usually is present in spaced adjacent relationship to the periphery of the spool of the rotating spindle assembly. The rotative movement of strand material displaced outwardly from the spool periphery, as by centrifugal and/or windage forces, and engaging a mechanical cleaner device is impeded by such engagement. This causes the connected strand material, including any disposed more closely adjacent the spool's periphery, to be subjected to forces which "worry" the same and tend to effect disengagement thereof from the spool.

It has been found, however, that the desired prompt and complete clearance of coil forming strand material from the spindle assembly spool does not reliably ensue in certain situations. One such situation is presented when, during formation of the coils upon the spool of the spindle assembly, the coil-forming strand material overlaps or crosses over itself. In a overlap situation, the overlapping strand material is always closer than the overlapped material to the material's end which is "downstream" in relation to the direction of rotation of the spindle assembly and which is urged by rotation-induced windage toward, rather than away from, the spool. The overlapping strand material therefore forces the overlapped material against the underlying body of the spool, and thus prevents or at least delays clearance of the coil-forming strand material from the spool. Delayed clearance of the coil forming strand material from the spool usually results in at least partial disintegration of the material into undesirable "fly". It additionally may result in the material moving downwardly upon the spool to a location from which its clearance is more difficult, if not impossible.

A second situation wherein prompt clearance of the coil forming strand from the spool does not reliably ensue is when adjacent ones of the coils laterally attach to each other with an attaching force of significant magnitude. This situation is most likely to arise when the strand is comprised at least in part from, and has outwardly projecting tendrils of, synthetic fibers having high strength and tenacity and a relatively long (e.g., 1.5 inches) staple length. As such material passes onto the spindle assembly spool during the coil forming operation, the twist-induced rotative movement which it then undergoes about its axis enhances the tendency of laterally engaging coils of the material to become firmly attached to each other by the tendrils projecting therefrom. Coils thus firmly attached to each other are less likely to be promptly cleared from the spool than are coils which are not so attached.

The amount of strand material wound upon the spool during each coil forming operation also is quite relevant to the relative ease or difficulty of the material's subsequent clearance. Maintainance during machine start-up of the connection between the strand source and a conventional spindle assembly spool, which customarily has knurling upon its peripheral surface, may require the presence of seven or more coils upon the spool when its knurling is worn and/or when the material is of a particularly "slippery" type. Subsequent clearance of the resulting two to three feet of coil forming strand material from the spool is much more time consuming and difficult than the clearance of a smaller amount of strand material. Upon clearance thereof from the spindle assembly spool, assuming that such does eventually transpire, the longer length of strand material is also much more likely to be cast onto and become entangled about an adjacent cleaner device or even the spool or some other part of an adjacent spindle assembly. This undesirable result is less likely to occur when the strand material is of shorter length.

DESCRIPTION OF THE PRIOR ART

In addition to previously noted U.S. Pat. No. 4,208,865, the following U.S. Patents may be deemed of interest: U.S. Pat. Nos. 3,319,409 4,013,237 and 4,050,645. U.S. Pat. No. 3,319,409 discloses a textile spindle assembly having a grooved collar above its coilreceiving spool. U.S. Pat. No. 4,013,237 discloses a textile winder having a grooved hub which laterally transfers a substantially perpendicularly extending textile strand toward a desired location preparatory to commencement of package formation. U.S. Pat. No. 4,050,645 discloses a grooved tube-like carrier of textile strand material.

SUMMARY OF THE INVENTION

The present invention provides, in association with a textile spindle assembly of the hereinbefore described type having a spool-like member upon which coils of textile strand material are formed preparatory to doffing of a strand package from the assembly, means for so controlling the position of the coil-forming strand material upon the spool member of the assembly as to more reliably result in prompt clearance of the material from the assembly.

In a more specific aspect thereof, the present invention provides means effective during formation of the coils for so progressively displacing successive increments of the coil-forming strand material axially of the spindle assembly spool as to virtually preclude all possibility of the material overlapping upon and/or laterally attaching to itself as the coils are formed.

In another more specific aspect thereof, the invention provides means for conducting or conveying strand material to a predetermined desired location upon the length or height of the spool of the spindle assembly, and/or for maintaining strand material at such location pending clearance thereof from the spool.

In still another more specific aspect thereof, the invention provides means for minimizing the amount of strand material that must be wound upon the spindle assembly spool during each coil forming operation.

In a specific preferred embodiment of the invention, desired ones of the aforesaid functions are performed by helical groove means provided in association with and extending helically about the periphery of the spindle assembly spool.

DESCRIPTION OF THE DRAWINGS

Other features of the invention will be apparent from the following description of an illustrative embodiment thereof, which should be read in conjunction with accompanying drawing, in which.

DESCRIPTION OF THE PREFERRED EMBODIMENT

Figure 1:
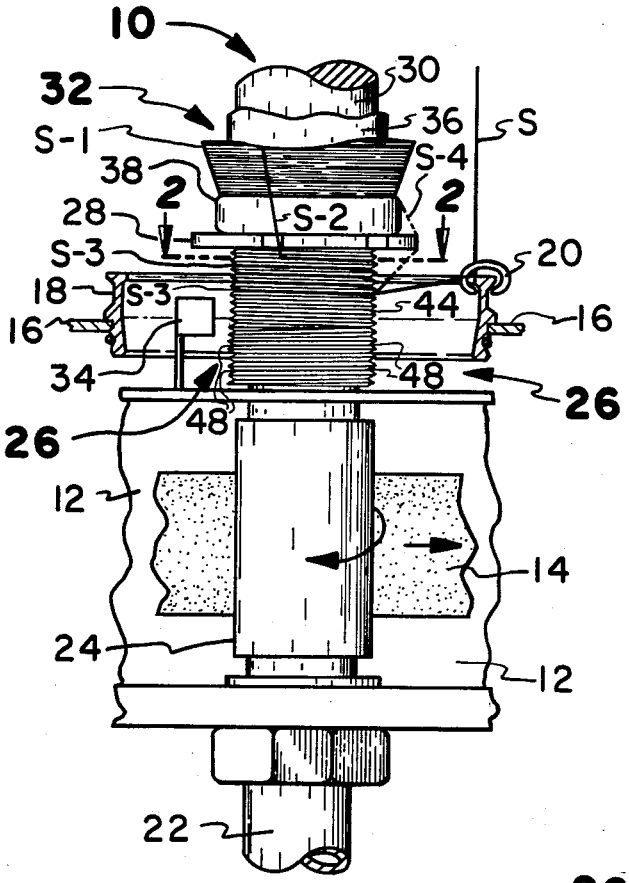
FIG. 1 is foreshortened front elevational view of a package-supporting textile spindle assembly in accordance with the invention, and of some fragmentarily shown adjacent components of a textile machine in which the assembly is mounted.

FIG. 1 shows one spindle assembly 10 and some additional components of a textile spinning frame or similar machine (not shown in its entirety). Apart from assembly 10, the illustrated machine components include a fixed spindle rail 12, a spindle drive belt or tape 14, a vertically movable ring rail 16, a ring 18 carried by rail 16, and a traveler 20 carried by and rotatable about the top flange of ring 18. Spindle assembly 10 includes a supporting bolster of bearing member 22, affixed to spindle rail 12, a whirl 24 driven by tape 14, a spool-like member 26, a collar-like member 28, and a blade member 30 (only fragmentarily shown). All of the foregoing members or parts of assembly 10 other than bolster 22 undergo rotative movement in unison with each about the vertically extending central axis of the assembly when the same is driven by tape 14.

FIG. 1 also shows a fragmentary portion of a conventional textile strand package 32 in association with the upper portion of assembly 10, and a mechanical cleaner device 34 mounted upon rail 12 in association with spool 26 of the assembly. There are many known types of mechanical cleaners, and device 34 is merely illustrative of one possible form thereof.

Package 32 is comprised of textile material S-1 wound about a tubular bobbin 36 encircling spindle blade 30 and having a base portion 38 overlying spindle collar 28. The package was formed in a conventional manner during regular package-building operation of the machine incorporating assembly 10. During such machine operation, package 32 underwent clockwise rotation in unison with the rotatable components of assembly 10, while ring rail 16 underwent vertical reciprocatory movement above spindle collar 28 and bobbin base 38. Strand material S then running from the machine's drafting rolls (not shown) or other strand source and through traveler 20 passed directly from the traveler to package 32, thus forming the wound strand material S-1 thereof.

The aforesaid package-building operation of the textile machine is followed, upon package completion, by so called "doff preparation." Ring rail 16 then moves rapidly downwardly to a position, such as that shown in FIG. 1, intermediate the length or height of spindle assembly spool 26 while assembly 10 rotates through a predetermined limited number of final revolutions. The strand material S passing through traveler 20 as the foregoing occurs first forms a length of strand material S-2 extending downwardly from package 32 across the notched periphery of spindle collar 28, and then forms a predetermined limited member of coils of strand material S-3 upon spool 26.

The next operational steps are "doffing" or removal of the completed strand package 32 from spindle assembly 10 and "donning" or placement of a replacement bobbin (not shown, but of the same construction as bobbin 36) thereon. Doffing of the completed package 32 separates the strand material S-2 innerconnecting such package and the coil-forming strand material S-3, but the latter maintains connection between assembly 10 and strand material S pending donning of the replacement bobbin and commencement of the formation of another strand package upon the assembly. Commencement of the new package occurs automatically when, during resumption of the textile machine's normal package-building operation, ring rail 16 moves upwardly from its illustrated depressed position to an elevation above spindle collar 28 and the base 38 of the new bobbin. The initial upward movement of rail 16 creates a length of strand material S-4, indicated in FIG. 1 by phantom lines, extending between the coil-forming material S-3 and the newly commenced strand package.

Figure 2:
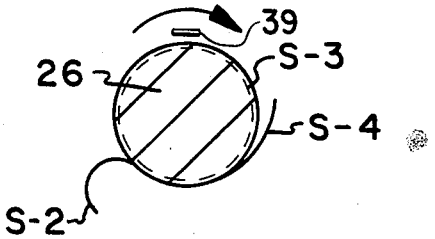
FIG. 2 is a sectional view taken along the line 2—2 through the spool-like member of the spindle assembly of FIG. 1, showing at a latter point in time end portions of textile strand material coiled thereabout.

The coil-forming strand material S-3 upon spindle assembly spool 26 is no longer needed after formation of the new package has been commenced and, of reasons discussed in U.S. Pat. No. 4,208,865, should be cleared from the spool prior to completion of such package. The first step toward achieving such result is that of separating strand S-4, which in its upstanding FIG. 1 condition constitutes a barrier preventing any appreciable unwinding of the spool-connected strand material from its free (by reason of prior separation of strand S-2) opposite end portion. Separation of strand S-4 may be achieved in any suitable manner including, but not limited to, any of those disclosed in U.S. Pat. No. 4,208,865. Means 39 for separating strand S-4, and thus freeing the material S-3 for clearance from spool 26, is schematically shown in FIG. 2. Following separation of strand S-4, clearance should ensue automatically due to windage and the other influences (centrifugal force and cleaner "worrying") previously noted herein. As is most readily apparent from FIG. 2 of the drawings, which shows the free remnants of strand S-2 and S-4 integral with the spool encircling strand material S-3, the windage generated by rotation of spool 26 has a clearing effect only upon the strand end portion which is "leading" in relation to the direction (illustratively clockwise) of spool rotation, i.e., upon the strand end portion that includes remnant S-2. The opposite or "trailing" strand end portion, which includes the remnant S-4, is forced by windage toward spool 26 rather than away from it.

Figure 4:
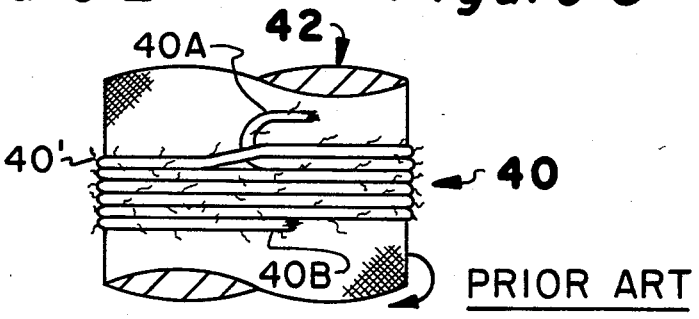
FIG. 4 is an enlarged fragmentary elevational view of a conventional spindle assembly spool member having overlapped and laterally connected strand material thereon.

As mentioned previously herein, prompt clearance is not possible in certain situations which may and all too frequently do arise when the spindle assembly spool is of a conventional construction. A number of these situations are illustrated by FIG. 4 of the drawings. This shows strand material 40, having leading and trailing end portions 40 A and 40 B, wound upon a conventional spindle assembly spool 42 having knurling upon its surface. It will be noted, firstly, that strand material 40 overlapped or crossed over itself during winding thereof upon spool 42. The single illustrated overlap (another on the rear side of the spool is not shown) immobilizes leading strand end 40 A and prevents the same from being forced away from spool 42 by windage. Prompt clearance of strand material 40 from the spool therefore cannot and will not transpire. An overlap condition might be created during any coil-forming operation utilizing a coventional spool since the smooth or knurled surface thereof is incapable of preventing such condition.

A second clearance-preventing condition illustrated in FIG. 4 is that of adjacent coils of the material 40 being attached to each by tendril-like fibers 40' projecting laterally therefrom. As the strand material 40 is wound upon spool 42 it undergoes twist-induced rotative movement about its axis. Any tendrils 40' then projecting from any coil of the material therefore tend to twist about and into any other coil engaged thereby. This may result in the coils becoming so firmly attached to each other as to prevent or at least significantly impede their clearance from spool 40. Such undesirable result it particularly likely to ensue when the strand material is comprised entirely or in part of very strong and tenacious synthetic fibers of relatively long staple length. The risk of at least some coil attachment via projecting tendrils is present, however, whenever the coils are not spaced from each other during the coil-forming operation.

A third clearance-retarding condition illustrated in FIG. 4 is the presence of an undesirably large number of coils of strand material 40 upon spool 42. Even when the knurling upon spool 42 is in good condition and the strand material 40 is of a standard type, the winding of some four to six coils upon a conventional spool during each coil-forming operation may be necessary to insure maintainance of the desired strand connection upon machine start-up. As a compensating factor, the number of coils wound upon a conventional spool normally would be further increased if the strand material were of a particularly "slippery" type and/or if the knurling upon the spool had become worn and smooth. It is therefore not particularly unusual for several feet of strand material strand to be wound upon a conventional spool. Such a length of material obviously cannot be cleared as promptly from the spool as a strand of short length. Additionally, if and when a long strand is cleared and cast away from the spool, there is considerable likelihood of its being cast onto and becoming entangled about an adjacent mechanical cleaner and/or some part of an adjacent spindle assembly. The shorter the length of the strand wound upon the spool, the greater the liklihood of its being promptly cleared from the spool and not thereafter presenting further problems of the aforesaid type.

Although not illustrated in the drawings, the coil-forming strand material wound upon a conventional spool tends to slide downwardly along the spool following separation of its strand connection to the new strand package. If the coil-forming strand material passes completely from the spool's lower end and onto the underlying section of the spindle assembly, retrieval thereof can normally be effected only after disengaging the spindle assembly from its supporting bolster. Even if the material remains on the spool, it may descend to a location beneath the effective range or reach of whatever type of mechanical cleaner is associated with the spool. Irrespective of how it might have arrived there, strand material at such a location upon the spool is less likely to be cleared therefrom.

Figure 3:
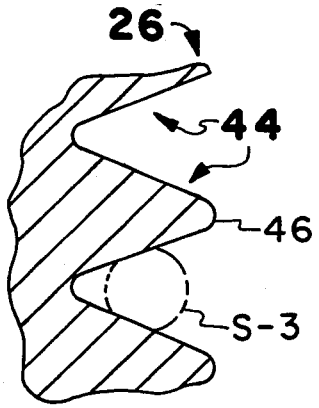
FIG. 3 is an enlarged fragmentary sectional view of a portion of the spool-like member of the spindle assembly.

Referring now once again to FIG. 1–3 of the drawings, means are provided in association with spool 26 of spindle assembly 10 for so positioning strand material upon the spool as to insure its prompt and complete clearance. In the illustrated form, such means includes a first helical groove 44 formed within and extending helically about the upper portion of spool 26. The direction of the relatively small (in relation to the horizontal) slope of groove 44 is dependent upon the direction of rotation of assembly 10. When the rotation direction is in the indicated clockwise direction, the groove slope is downward from left to right, as seen in FIGS. 1 and 3, in keeping with that of a lefthand screw thread. If the direction of spindle rotation were in the opposite direction, the slope of groove 44 would also be in the opposite direction. As is best shown in FIG. 3, groove 44 preferably and illustratively has a generally V-shaped cross-sectional shape defining an included angle of approximately forty-five degrees. The complementarily shaped ridge or land 46 separating vertically adjacent sections of the groove deflects any strand material S-3 engaging it into the groove, and is sufficiently rounded or radiused as to not cut the strand material. The tranverse dimensions of groove 44 are such that strand material S-3 is readily received by the groove's "mouth" or outer portion and is laterally constricted within an inner portion of the groove.

The aforesaid constriction of strand material S-3, which is indicated in FIG. 3 by the flattened opposite sides of the segment thereof shown in phantom lines, occurs when the material is under sufficient tension to effect its passage into and its maintainance within the inner portion of groove 44. Strand material S-3 is under such tension while the coils thereof are wound upon spool 26 and until strand S-4 (FIG. 2) is separated. The retentive force imposed upon strand material S-3 by its tension-induced and bilaterally directed constriction within groove 44 is of appreciably greater magnitude than the retentive force that would be imposed upon the same amount of strand material if wound upon the knurled surface of a conventional spindle assembly spool. Consequently, only a small number of coils need be formed upon spool 26 during each coil-forming operation. While a greater number is shown in FIG. 1 for purposes of illustration, two or three coils will likely suffice in most instances.

As ring rail 16 descends below collar 28 of assembly 10 during doff-preparation operation of the texile machine, an upwardly disposed portion of groove 44 necessarily must and does receive an initial increment of strand material S-3 passing from traveler 20 to spool 26. Successive increments of strand material S-3 are then progressively displaced downwardly by the groove, which causes the strand material to follow its downward helical path about the spool. Overlapping of strand material S-3 upon itself therefore cannot and does not occur. Since vertically adjacent coils of material S-3 are separated from and maintained out of engagement with each other, by the intervening ridge or land 46, it also is impossible for the coils to attach laterally to one another even if strong and tenacious fiber tendrils project therefrom.

Separation of strand S-4 (FIG. 2) untensions strand material S-3 and allows it to move outwardly from the inner portion of groove 44. Such outward movement may be initiated not only by the centrifugal forces imposed upon all the material S-3 and by the windage force imposed upon the leading end thereof integral with strand remnant S-2 (FIG. 2), but also by the inherent tendency of the strand material to expand back to its normal cross-sectional shape when no longer constrained by tension in its deformed shape of FIG. 3. The interior angulation (see FIG. 3) of groove 44 is sufficiently great as to prevent "self-locking" of the untensioned strand material therewithin.

The windage forces upon the leading end portion of strand material S-2-4 cause such portion to "grow" or lengthen. At the same time the material is being displaced downwardly by groove 44 toward the central portion of spool 26 and toward the elevation of the "working" upper section of the mechanical cleaner device 34 spaced radially outwardly from the spool. If windage alone has not effected complete clearance of all the strand material from spool 26 by the time the growing leading end portion thereof reaches the elevation of cleaner 34, such leading end portion of the material will engage and be "worried" by the cleaner until complete clearance of the material from the spool has been effected. In any event, clearance should be effected quite rapidly since the strand material is neither overlapped, joined laterally together or of excessive length.

A second helical groove 48 (FIG. 1) may be and illustratively is provided upon the lower half of spool 26. Groove 48 is identical to previously described groove 44 except for its sloping in the opposite direction. By reason of its reverse slope, groove 48 prevents any spool encircling material descending toward it from passing below a horizontal plane passing centrally through the working section of cleaner 34. Additionally, any strand material that might in any manner become entangled about the lower portion of spool 26 is conveyed upwardly by groove 48 to the location of the aforesaid plane, and is there cleared from the spool by the worrying action of cleaner 34. Any "foreign" strand material becoming entangled upon the upper portion of spool 26 is similarly, and with the same result, conveyed downwardly to the clearer location by groove 44.

As shown in FIG. 1, spool 26 is connected to whirl 24 by a reduced diameter portion of spindle assembly which projects through a bore (not shown) in the top flange of spindle rail 12. Such conventional construction might if desired be improved by extending spool 26, or a cylindrical or tapered extension thereof, downwardly towards whirl 24, so that such strand material as has heretofore tended to wrap and remain about the spindle portion therebetween would instead be conveyed upwardly to cleaner 34.

The location to which grooves 44, 48 convey strand material is of course dependent upon the location of the particular cleaner device associated with the spindle assembly. If, for instance, the cleaner were closely adjacent the lower end of spool 26 rather than adjacent its center, groove 44 would extend along the major part of the spool and groove 48 along only a minor lower part thereof.

The grooved spool member may be of either unitary or sectional construction, and of either cylindrical or tapered shape, and nothing contained herein is intended to indicate otherwise.

Although a specific embodiment of the invention has been shown and described, this was for purpose of illustration only, and not for purpose of limitation.

We claim:

1. In a textile machine having a rotatable spindle assembly of the type used in the formation of successive yarn packages of textile strand material and including a spool-like member about which coils of the strand material are adapted to be formed preparatory to doffing of each of said packages, said machine having means for freeing said coils for clearance from said member during formation of the next ensuing one of said packages, the improvement comprising:

said spool-like member having strand guiding means for, during formation of said coils, so progressively displacing successive increments of the coil-forming strand material longitudinally of said member as to prevent overlapping of said coil-forming strand material upon itself.

2. In a textile spinning machine or the like including a spindle assembly rotatable about a generally vertical axis and having a blade member about which packages of strand material are adapted to be formed, and having a spool-like member underlying said blade member and adapted to receive coils of strand material preparatory to doffing of each one of said strand packages; said machine including means for freeing said coils for clearance from said spool-like member during formation of the next ensuing one of said packages; the improvement comprising:

strand guiding means associated and rotatable with said assembly for preventing overlapping of the strand material of said coils upon itself during formation of said coils upon said spool-like member.

3. In a textile machine including a rotatable spindle assembly for forming successive packages of textile strand material; said assembly having a first member about which each one of said packages is formed, and having a second member upon which coils of strand material are wound following formation and preparatory to doffing of said each one of said packages; said machine including means for freeing said coils for clearance from said second member during formation of the next ensuing one of said packages, the improvement comprising:

said second member having groove means upon the outer surface thereof for receiving successive increments of the coil forming strand material and for causing the same to follow, during formation of said coils, a nonoverlapping and generally helical path away from said first member.

4. In a textile machine including a rotatable spindle assembly of the type used in the formation of successive packages of textile strand material, said assembly including a spool-like member upon which coils of the strand material are wound preparatory to doffing of each yarn package; said machine including means for freeing said coils for clearance from said member during the next ensuing package-building operation of said assembly, the improvement comprising:

said spool-like member having helical groove means associated therewith for preventing overlapping of said coils upon each other during the winding thereof upon said member, and for axially positioning strand material upon said member at a predetermined location facilitating clearance thereof from said member.

5. A spindle assembly as in claim 1, wherein said strand guiding means comprises a groove disposed within and opening from the exterior surface of said member and extending spirally thereabout, said coil-forming strand material being received within said groove and constrained thereby to follow a helical path during formation of said coils.

6. A spindle assembly as in claim 5, wherein said groove has a generally V-shaped cross-sectional configuration.

7. A spindle assembly as in claim 5, wherein said groove has a relatively large outer portion adapted to freely receive the coil-forming strand material and a relatively small inner portion adapted to constrict the coil-forming strand material.

8. A spindle assembly as in claim 1, wherein said member has a second helical groove disposed within and extending helically about said exterior surface of said member in a direction opposite to that of said first-mentioned groove.

9. A textile machine as in claim 2, wherein said strand guiding means comprises helical groove means encircling said spool-like member for causing said coils to follow a downwardly extending helical path and for spacing vertically adjacent ones of said coils from each other.

10. A spindle assembly as in claim 3, wherein said groove means is a continuous helical groove.

11. A spindle assembly as in claim 10, wherein said groove is of generally V-shaped cross-sectional configuration and has converging sides defining an included angle of approximately forty-five degrees.

12. A spindle assembly as in claim 10, wherein said member has a second helical groove extending thereabout in a direction opposite to that of said first mentioned groove.

13. A textile assembly as in claim 4, wherein said groove means includes a first groove and a second groove each extending helically about said member.

14. A textile assembly as in claim 13, wherein said first groove and said second groove extend in opposite helical directions.

15. A spindle assembly as in claim 13, wherein said first groove and second grooves are respectively adjacent first and second opposite ends of said member.

16. A spindle assembly as in claim 13, wherein each of said grooves directs thereby engaged strand material towards the other of said grooves and toward said predetermined location.

17. In the method of winding strand material extending from a source to a rotatable textile spindle assembly having a first member upon which strand packages are adapted to be successively formed, and a second member spaced along the length of the assembly from the first-mentioned member; said method including the steps of (a) winding strand material upon the first member to form each strand package, (b) winding strand material upon the spool member preparatory to doffing each completed strand package from the assembly so as to form thereon a plurality of coils of strand material effective to maintain strand connection between the assembly and the strand source upon doffing of the formed package from the assembly, and (c) freeing the coils for clearance from the spool member during formation of the next ensuing strand package; the improvement comprising:

completing step (b) without overlapping the coil forming strand material upon itself.

18. The method of claim 17, and further including maintaining the coils of strand material, during the winding thereof upon the second member, in spaced nonengaging relationship to each other.

* * * * *